US009341347B2

(12) United States Patent
Zanon et al.

(10) Patent No.: US 9,341,347 B2
(45) Date of Patent: May 17, 2016

(54) METHOD FOR MOUNTING LIGHTING MODULES AND EQUIPMENT THEREFOR

(71) Applicant: OSRAM GmbH, Munich (DE)

(72) Inventors: Franco Zanon, Cassola (IT); Alessio Griffoni, Fossó (IT); Simon Bobbo, Chirignago (IT); Alessandro Scordino, Dolo (IT)

(73) Assignee: OSRAM GmbH, Munich (DE)

( * ) Notice: Subject to any disclaimer, the term of this patent is extended or adjusted under 35 U.S.C. 154(b) by 315 days.

(21) Appl. No.: 14/024,677

(22) Filed: Sep. 12, 2013

(65) Prior Publication Data

US 2014/0085892 A1 Mar. 27, 2014

(30) Foreign Application Priority Data

Sep. 27, 2012 (IT) ..... TO2012A0841

(51) Int. Cl.

| | |
|---|---|
| ***F21V 17/06*** | (2006.01) |
| ***F21V 17/12*** | (2006.01) |
| ***F21V 21/00*** | (2006.01) |
| ***F21V 19/00*** | (2006.01) |
| ***F21V 19/04*** | (2006.01) |

(52) U.S. Cl.

CPC ..... *F21V 17/12* (2013.01); *F21V 19/0015* (2013.01); *F21V 19/0055* (2013.01); *F21V 19/045* (2013.01); *F21V 21/00* (2013.01); *Y10T 29/49128* (2015.01)

(58) Field of Classification Search

CPC ..... G02F 1/133608; F21V 19/0015; F21V 21/00; F21V 21/02; F21V 21/03; F21V 17/10; F21V 17/108; F21V 17/12; F21V 19/00; F21V 21/008; F21S 4/003; F21S 8/04; F21S 48/1109; F21Y 2105/00; F21Y 2101/02; F21Y 2103/00; F21Y 2113/00

USPC ..... 362/145–148, 217.1, 217.11–217.17, 362/249.01, 249.02, 260, 365, 368, 404, 362/632–634

See application file for complete search history.

(56) References Cited

U.S. PATENT DOCUMENTS

| | | | |
|---|---|---|---|
| 2009/0096341 | A1 | 4/2009 | Dobler et al. |
| 2011/0248615 | A1 | 10/2011 | Tsai |

FOREIGN PATENT DOCUMENTS

| | | | |
|---|---|---|---|
| DE | 102007049310 | A1 | 4/2009 |
| DE | 202010009679 | U1 | 9/2010 |
| EP | 2381157 | A2 | 10/2011 |

*Primary Examiner* — Hargobind S Sawhney

(74) *Attorney, Agent, or Firm* — Viering, Jentschura & Partner mbB

(57) ABSTRACT

A method for mounting planar lighting modules on a mounting surface may include: providing on opposite sides of the lighting module fixing indentations opening toward the aforesaid sides, superimposing on said opposite sides of the lighting module stiffening bars having lateral lobes extending into said indentations, and fixing to the mounting surface the stiffening bars superimposed on the opposite sides of the lighting module with the opposite sides of the lighting module sandwiched between the stiffening bars and the mounting surface, whereby the stiffening bars urge the lighting module toward the mounting surface.

9 Claims, 3 Drawing Sheets

METHOD FOR MOUNTING LIGHTING MODULES AND EQUIPMENT THEREFOR

RELATED APPLICATIONS

The present application claims priority from Italian application No.: TO2012A000841 filed on Sep. 27, 2012.

TECHNICAL FIELD

Various embodiments relate to the mounting of lighting modules. Various embodiments may relate to the mounting of solid state planar lighting modules, for example lighting modules using LED sources as light radiation sources.

BACKGROUND

In the field of solid state lighting (SSL) sources there is a growing tendency to devise modules, such as LED modules, with geometries such that they allow standardized mechanical interconnection, in order to simplify the installation of systems and the interchangeability of parts. For example, the positions of the LEDs and screw holes are currently undergoing standardization by Zhaga. The name "Zhaga" has been given to a collaborative consortium of companies in the lighting technology industry, set up with the aim of facilitating interchangeability of solid state lighting sources, such as LED sources, made by different manufacturers, in order to facilitate, for example, general lighting technology applications.

In various solutions, the characteristics of thermal coupling between the module and the mounting surface may be affected by the ways in which the lighting module (which may have a substrate formed by a structure similar to that of a printed circuit board (PCB), with a metal base for example) is fixed to the mounting surface (which may be a heat sink or a lighting system, for example). For example, the high thermal power densities generated by arrays (clusters) of LEDs may give rise to mechanical stresses in the substrate of the module; if the module is fixed to the mounting surface at certain isolated points only, substrate deformation phenomena may occur, such that the contact surface is reduced and the performance in terms of heat dissipation is adversely affected.

In order to overcome these drawbacks, it is possible to make use of rigid casings (which are rather bulky) and/or to add further holes for fixing the substrate, so as to improve the pressure distribution. Leaving aside any other consideration, the latter solution may be impracticable if the lighting system and/or the heat sink are already provided with mounting holes according to standardized solutions, thus making it necessary to create further fixing holes.

SUMMARY

Various embodiments have the object of overcoming the aforementioned drawbacks.

Various embodiments may offer one or more of the following advantages:

- improvement of the thermal performance;
- assured thermal stability over time;
- continuity of the lighting characteristics over time;
- economy of the solution;
- the possibility of avoiding the use of special tools or instruments for mounting the lighting module.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments.

In the following description, various embodiments described with reference to the following drawings, in which.

DETAILED DESCRIPTION

The following detailed description refers to the accompanying drawing that show, by way of illustration, specific details and embodiments in which the disclosure may be practiced The reference to "an embodiment" in this description is intended to indicate that a particular configuration, structure or characteristic described in relation to the embodiment is included in at least one embodiment. Therefore, phrases such as "in an embodiment", which may be present in various parts of this description, do not necessarily refer to the same embodiment. Furthermore, specific formations, structures or characteristics may be combined in any suitable way in one or more embodiments.

The references used herein are provided purely for convenience and therefore do not define the scope of protection or the extent of the embodiments.

Figure 1:
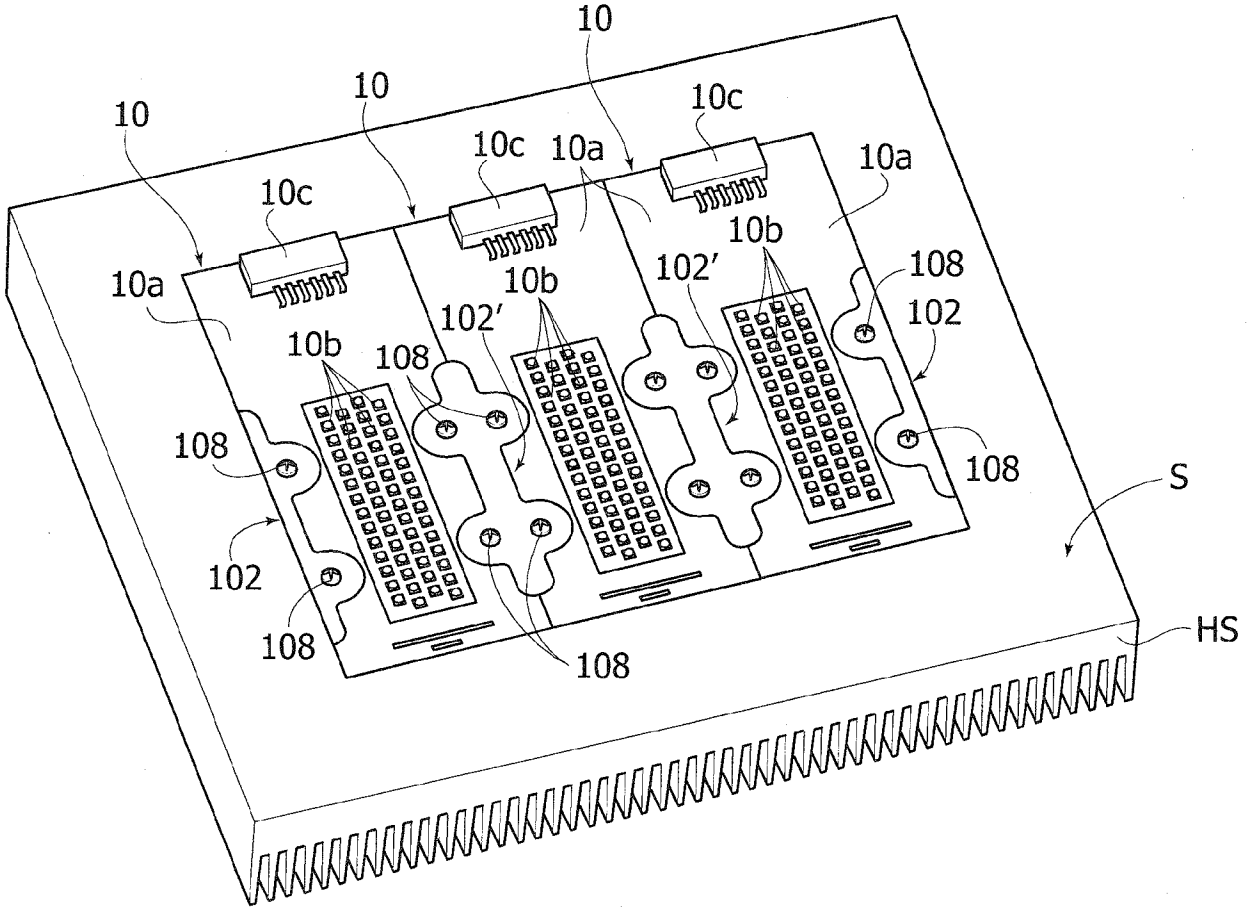
FIG. 1 is a perspective view of some embodiments.

The perspective view of FIG. 1 shows an example of a mounting arrangement for mounting a plurality of lighting modules 10 (three in the example illustrated here, although any number of modules could be used, from 1 to a generic number n), which are mounted on a mounting surface S.

In the embodiment illustrated here, which is of the aforementioned type, the surface S comprises the flat top face of a heat sink HS having fins for heat dissipation on the side opposite the surface S.

The lighting modules 10 described here by way of example may be planar lighting modules, each comprising a substrate 10*a* made in a form similar to a printed circuit board (PCB) on which is arranged a solid state light radiation source composed, for example, of an array or cluster of LEDs 10*b*. The figures also show electric and/or electronic circuitry 10*c* mounted on the substrate 10*b* and intended to provide a power supply to the light radiation sources 10*b* and control of the latter if required.

Solid state planar lighting modules of this kind are known in the prior art. In various embodiments, the modules 10 may be made (in respect of their shape, dimensions, electrical, mechanical and thermal characteristics, and the like) in accordance with Zhaga standards.

As mentioned above, various embodiments are suitable for use in mounting any number of planar lighting modules 10 on a mounting surface S.

Figure 6:
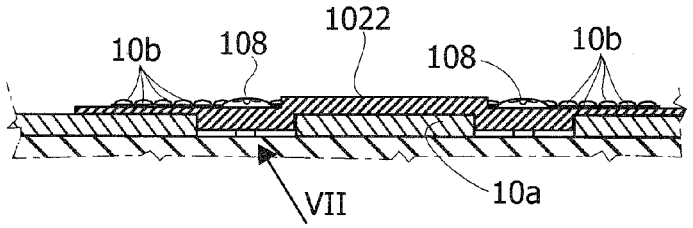
FIG. 6 is a sectional view taken along the line VI-VI of FIG. 5, reproduced on a magnified scale.
Figure 7:
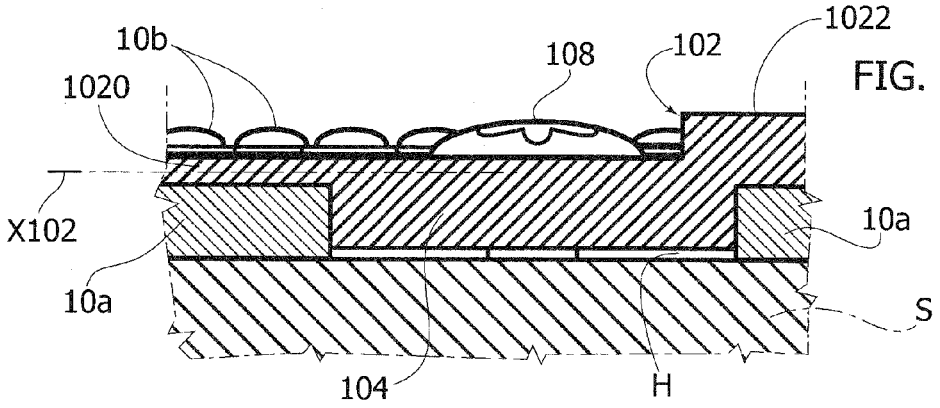
FIG. 7 shows, on a scale magnified further, the portion of FIG. 6 indicated by the arrow VII.
Figure 8:
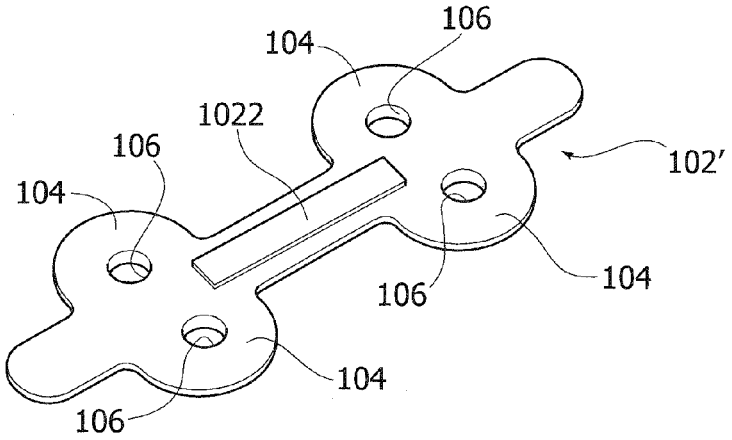
FIG. 8 shows a component which can be used in some embodiments.

FIGS. 2 to 7 relate primarily to the mounting principles that can be used for a single module 10: in various embodiments, these principles can be extended, using components such as those shown in FIG. 8 where appropriate, to a plurality of n modules 10: for example, FIG. 1 shows an example of the mounting of n=3 modules 10 arranged adjacently on the surface S.

In various embodiments, the module 10 (and, more specifically, the substrate 10*a* thereof) may be of any shape: the rectangular shape shown in the drawings is only one example of various possible shapes.

Regardless of its shape, the module 10 may have two opposite sides in which are provided fixing apertures formed by indentations or incisions 100 opening toward the sides of the module 10.

In various embodiments, the indentations or incisions 100 may be U-shaped (or V-shaped, or more generally channel-shaped).

In various embodiments, the module or modules 10 can be fixed onto the mounting surface S by using stiffening bars 102 intended to be superimposed on the opposite sides of the module 10 and having lateral lobes 104 intended to engage the indentations 100.

In the lobes 104 there are provided holes 106 through which fixing members such as screws 108 can extend, these members being, for example, screwed into threaded holes provided in the surface S (not shown in the drawings) in order to retain the module or modules 10 on the surface S.

In various embodiments, the stiffening bars 102 (and the bars 102' described below) may be made from polymers, for example polymers with a low coefficient of thermal expansion (CTE).

Figure 2:
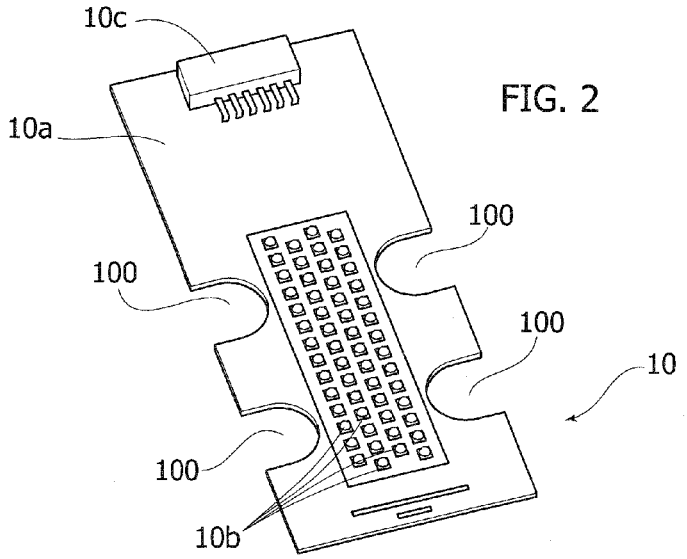
FIG. 2 is a perspective view of a lighting module which can be used according to some embodiments.
Figure 3:
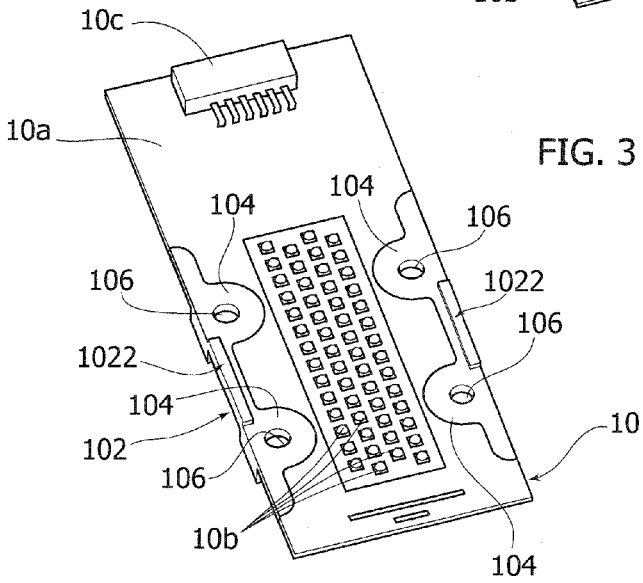
FIGS. 3 and 4 show, from approximately opposite viewpoints, the implementation of some embodiments.
Figure 4:
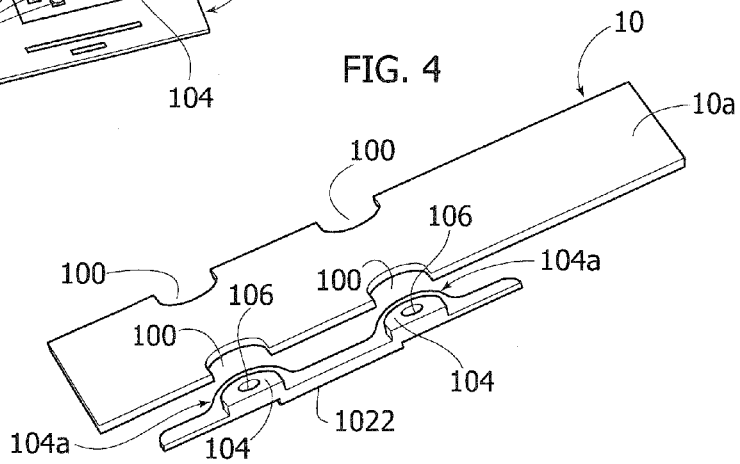
Figure 5:
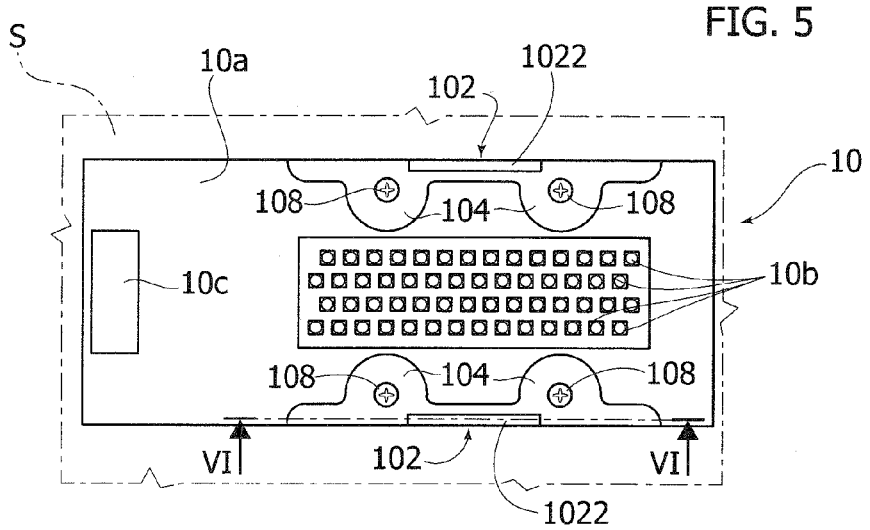
FIG. 5 shows a lighting module in plan view.

FIG. 4, which can be considered as an idealized view of a module 10 viewed from below, that is to say from a viewpoint approximately opposed to that of FIGS. 1 to 3, shows by way of example some possible characteristics of various embodiments.

For example, in various embodiments, a generally channel-shaped profile of the indentations or incisions 100 (for example, a U-shaped profile) may allow the stiffening bars 102 to be translated, at least slightly, toward the inside or outside of the module 10 (that is to say, moved transversely relative to the sides where the indentations 100 are provided), with the possibility of adjusting the positions of the holes 106 to make them coincide with threaded holes provided in the surface S for screwing in the screws 108.

In various embodiments (as can be seen more clearly, for example, in the cross-sectional views of FIGS. 6 and 7), the stiffening bars 102 may each have a core layer 1020 extending along a general plane of extension (indicated by X102 in FIG. 7) of the bar 102.

In various embodiments, the following elements may project from the core layer 1020 (and therefore from the plane X102):

- the lobes 104, on a side intended to face toward the mounting surface S, and
- a stiffening rib 1022 capable of imparting further rigidity to the bar 102 on the opposite side, that is to say on the side opposite the mounting surface S.

Thus, as shown more clearly in the view of FIG. 4, in various embodiments the lobes 104, intended to extend into the indentations or incisions 100, are surrounded by flanges 104*a*: consequently, when the stiffening bars 102 are superimposed on the opposite sides of the lighting module 10, the aforesaid flanges 104*a* can bear against the lighting module 10 around the indentations 100.

In various embodiments, the "height" or "thickness" of the lobes 104, that is to say their dimension measured in a direction orthogonal to the general direction of extension of the bar 102 (and therefore in a direction orthogonal to the plane of the surface S and of the substrate 10*a* of the modules 10) may be chosen so as to be slightly smaller than the corresponding dimension of the incisions 100.

In other words, in various embodiments, the thickness of the substrate 10*a* of the modules 10 may be chosen in such a way that, when the modules 10 are applied against the surface S and the stiffening/fixing bars 102 are superimposed on them and held in position by fixing members such as the screws 108 (see, in particular, FIG. 7), the end face of the lobes 104 facing the surface S is at least marginally raised or detached from the surface S, thus creating an interval or gap indicated by H in FIG. 7.

In various embodiments, the size of this interval or gap may, for example, be 200 micrometers.

Thus it is possible to provide a uniform distribution of the pressure with which the lighting module 10 is pressed by the bars 102 against the surface S, which may, for example, be formed by a heat sink.

In various embodiments, it is also possible to adjust precisely the intensity of this pressure by adjusting the intensity of the action exerted by the fixing members (in the exemplary embodiment considered herein, this would be done by adjusting the degree of tightening of the screws 108).

FIG. 8 shows by way of example the possibility of using stiffening bars 102', which can be considered as "double" bars, for fixing two modules 10 intended to be mounted in adjacent positions (see, for example, FIG. 1).

In various embodiments, these may be bars having the various characteristics described above with reference to "single" bars 102, but with the presence of lobes 104 extending, for example in symmetrical positions, on opposite sides of the central body of the bar, thus making it possible to engage indentations or incisions 100 provided, in corresponding positions for example, that is to say facing each other, in modules 10 intended to be mounted in adjacent positions.

In order to implement the embodiments, the installer may be provided with equipment comprising a set of modules 10 of the type shown herein by way of example, combined with a set of stiffening bars made either in the "single" version indicated by 102 or in the "double" version indicated by 102'.

Two single bars 102 enable a single module 10 to be mounted by fixing (with screws 108 for example) to the mounting surface S with the stiffening bars 102 superimposed on the opposite sides of the lighting module 10, and therefore with the opposite sides of the lighting module 10 sandwiched between the stiffening bars 102 and the mounting surface S, with the stiffening bars 102 urging the lighting module 10 toward the mounting surface S.

Two single bars 102 can also be used to mount each module 10 in an array of adjacent modules 10 by the same procedures.

FIG. 1 shows an example of the possibility of using both versions of the stiffening bars to mount a plurality of adjacent modules 10, using the "double" bars 102' in the inner positions of the array (one double bar 102' being interposed between and acting on two adjacent modules 10) and the "single" bars 102 for the outer positions of the array.

While the disclosed embodiments has been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A method for mounting planar lighting modules on a mounting surface, the method comprising:

providing on opposite sides of at least one of said lighting modules fixing indentations opening on said opposite sides, providing the stiffening bars with flanges which extend around lateral lobes extending into said indentations, superimposing the stiffening bars on the opposite sides of the lighting module with said flanges bearing against the lighting module around the indentations in said opposite sides, and fixing to the mounting surface the stiffening bars superimposed on the opposite sides of the lighting module with the opposite sides of the lighting module sandwiched between the stiffening bars and the mounting surface, whereby the stiffening bars urge the lighting module toward the mounting surface.

2. The method as claimed in claim 1, further comprising fixing the stiffening bars to the mounting surface by screwing.

3. The method as claimed in claim 1, further comprising providing holes in said lobes for the passage of fixing members to the mounting surface.

4. The method as claimed in claim 1, further comprising shaping the indentations in the lighting module and the lobes in the stiffening bars so as to allow mutual adjustment by moving the stiffening bars in a transverse direction with respect to said opposite sides of the lighting module.

5. The method as claimed in claim 1, further comprising making the lobes in the stiffening bars thinner than the indentations into which these lobes extend, so that, when the lobes of the stiffening bars extend into the indentations of the lighting module, an interval or gap is present between the mounting surface and the lobes.

6. The method as claimed in claim 1, further comprising:

mounting a pair of said planar lighting modules adjacently to each other on a mounting surface, so that the adjacent lighting modules have mutually facing sides provided with said indentations, fixing the adjacent modules to the mounting surface by means of a stiffening bar which is common to the adjacent modules, the common stiffening bar being superimposed on said mutually adjacent sides with lateral lobes extending into indentations provided in both of said adjacent modules.

7. The method as claimed in claim 6, further comprising:

arranging the indentations in said mutually facing sides of the adjacent lighting modules in pairs of aligned indentations, each pair comprising indentations each provided in a respective side between said mutually adjacent sides, providing the common stiffening bar with pairs of lateral lobes, each pair comprising lobes extending mirror-fashion on opposite sides of the common stiffening bar.

8. A method for mounting planar lighting modules on a mounting surface, the method comprising:

providing on opposite sides of at least one of said lighting modules fixing indentations opening on said opposite sides, superimposing on said opposite sides of the lighting module stiffening bars having lateral lobes extending into said indentations, providing said stiffening bars with reinforcing ribs extending between adjacent lobes on the opposite sides of the stiffening bars from the lighting module, and fixing to the mounting surface the stiffening bars superimposed on the opposite sides of the lighting module with the opposite sides of the lighting module sandwiched between the stiffening bars and the mounting surface, whereby the stiffening bars urge the lighting module toward the mounting surface.

9. A method for mounting planar lighting modules on a mounting surface comprising:

providing a set of the planar lighting modules having opposite sides with said fixing indentations, providing a set of the stiffening bars configured to be superimposed on said opposite sides of the lighting modules, said stiffening bars having said lateral lobes capable of being extended into said indentations, providing on opposite sides of the lighting module fixing indentations opening on said opposite sides, superimposing on said opposite sides of the lighting module stiffening bars having lateral lobes extending into said indentations, and fixing to the mounting surface the stiffening bars superimposed on the opposite sides of the lighting module with the opposite sides of the lighting module sandwiched between the stiffening bars and the mounting surface, whereby the stiffening bars urge the lighting module toward the mounting surface.

* * * * *